US005170591A

United States Patent [19]

Brielmaier et al.

[11] Patent Number: 5,170,591

[45] Date of Patent: Dec. 15, 1992

[54] METHOD FOR INTERNALLY CLEANING POWDER-CARRYING LINES

[75] Inventors: Peter Brielmaier, Ravensburg; Manfred Schüler, Daaden, both of Fed. Rep. of Germany

[73] Assignee: J. Wagner GmbH, Fed. Rep. of Germany

[21] Appl. No.: 688,477

[22] Filed: Apr. 22, 1991

[30] Foreign Application Priority Data

Apr. 24, 1990 [DE] Fed. Rep. of Germany ..... 4013060

[51] Int. Cl.[5] ..... B24C 1/00

[52] U.S. Cl. ..... 51/320; 51/321; 51/319

[58] Field of Search ..... 51/410, 411, 424, 425, 51/426, 317, 319, 320, 321

[56] References Cited

U.S. PATENT DOCUMENTS

| | | | |
|---|---|---|---|
| 818,776 | 4/1906 | Murray | 51/424 |
| 4,044,507 | 8/1977 | Cox et al. | 51/319 |
| 4,412,402 | 11/1983 | Gallant | 51/321 |
| 4,773,189 | 9/1988 | MacMillan et al. | 51/425 |
| 5,011,443 | 3/1991 | Park | 51/320 |

FOREIGN PATENT DOCUMENTS

| | | | |
|---|---|---|---|
| 383057 | 10/1986 | Austria . | |
| 2849269 | 11/1978 | Fed. Rep. of Germany . | |
| 2930121 | 7/1979 | Fed. Rep. of Germany . | |
| 3028588 | 7/1980 | Fed. Rep. of Germany . | |
| 3408828 | 3/1984 | Fed. Rep. of Germany | 51/320 |
| 1384742 | 2/1975 | United Kingdom . | |
| 2073630 | 4/1980 | United Kingdom | 51/410 |

*Primary Examiner*—Bruce M. Kisliuk
*Assistant Examiner*—Bo Bounkong
*Attorney, Agent, or Firm*—Hill, Van Santen, Steadman & Simpson, A Proffesional Corporation

[57] ABSTRACT

A method for internally cleaning a powder-carrying hose conduit of an electrostatic powder coating system between changes in powder color. A granule/air stream is conducted through the hose to be cleaned, and the granules are returned for re-use after they emerge from the hose.

10 Claims, 1 Drawing Sheet

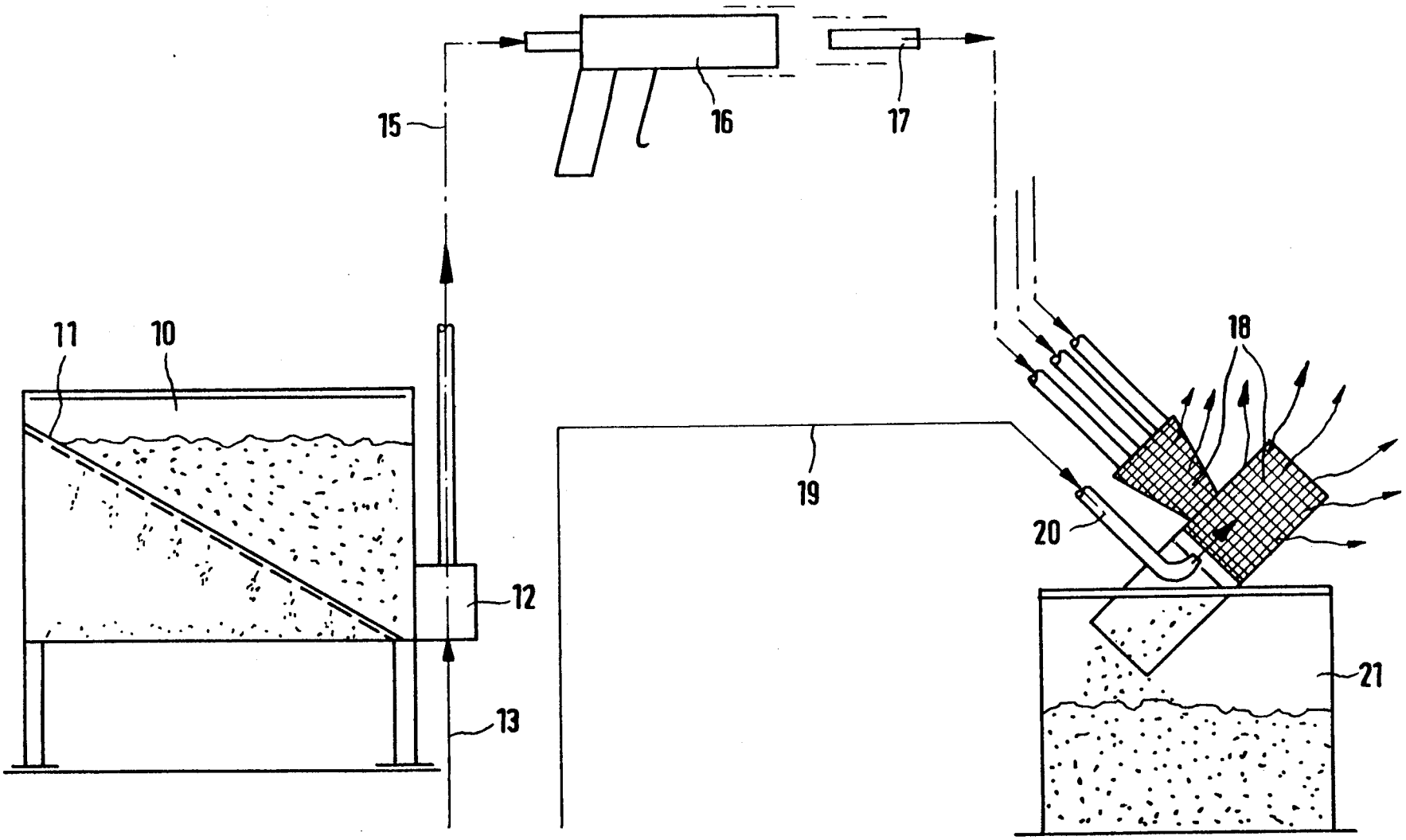
10
11
12
13
15
16
17
18
19
20
21

METHOD FOR INTERNALLY CLEANING POWDER-CARRYING LINES

FIELD OF THE INVENTION

The invention is directed to a method for internally cleaning a powder-carrying line, particularly for cleaning a hose conduit of an electrostatic powder coating system to facilitate a change of coating powder color.

BACKGROUND OF THE INVENTION

When changing powder colors in an electrostatic powder coating-system, the powder-carrying connecting lines, the spray compartment, the powder containers and the spray guns must be thoroughly cleaned. Using presently known methods and apparatus, it is particularly difficult to clean powder hoses. By contrast to cleaning the compartments or containers (which may be manually cleaned with brooms, or automatically cleaned with moving brush and blower systems), powder hoses have up to now been relatively unsatisfactorily cleaned by blowing compressed air therethrough. The new powder color must then be first sprayed "into the open air", to ensure that all of the residual powder has passed out of the hoses. Such practice is both unreliable and uneconomical. It is therefore standard practice to replace the powder hoses between each color change, so that a separate hose is provided for every color. Replacing hoses can be complicated and time-consuming, particularly with frequent color changes. In automated or robotic systems, hose replacement is particularly problematic, since the hoses must be re-secured to the points of articulation of the mobile spray gun mounting structure.

SUMMARY OF THE INVENTION

It is therefore an object of the instant invention to create a simple, quickly implemented, and relatively efficient method of internally cleaning powder-carrying lines without having to disconnect the lines from the spray guns or from the mobile spray gun mounts.

In the present invention, powder-carrying lines are internally cleaned by conducting granules through the line at comparatively high speed. The only procedure involving the powder hoses is that the hoses are disconnected from the powder supply container, and connected to a granule delivery apparatus. By contrast, presently known systems require disconnection of the powder hose from the spray guns, or from the mobile spray gun mounts.

In the present invention, the granules also pass through and clean the powder-carrying passages within the spray guns. Tests have shown that the present invention is unexpectedly effective in cleaning powder residue from the lines, and that, after the cleaning process, the powder carried by the granules can be simply separated therefrom, thus allowing the granules and the powder to be re-used.

An exemplary embodiment of the present invention provides a method of internally cleaning powder-carrying lines in an electrostatic powder coating system wherein air entrained coating powder having a predetermined particle size is conducted through the powder carrying lines at a predetermined velocity and at a predetermined volume per unit time. A supply of cleaning granules is provided, with granules having a granule size greater than the particle size of the coating powder. The granules are entrained in a stream of compressed air to form a granule/air stream which is passed through the powder-carrying lines at a velocity in excess of the predetermined velocity of powder through the same system. The granule/air stream picks up residual powder within the powder-carrying lines to form a powder/granule/air stream. After the powder/granule/air stream has exited the powder coating system, the granules are separated from the powder/granule/air stream, and retained for re-use. The granule/air stream may be passed through the powder carrying lines at a volume per unit time greater than the predetermined volume per unit time.

An apparatus embodying the principles of the present invention may be provided in conjunction with an electrostatic powder coating system including a spray gun having an outlet removably connected to a nozzle assembly, and also connected to a powder container via a powder delivery hose. The apparatus includes a mechanism for connecting the powder delivery hose to the supply of cleaning granules. A return hose, which terminates in a granule separation device, is also provided, with the return hose being connectable to the spray gun outlet after removal of the nozzle assembly. An injector arrangement is provided for entraining the granules in a stream of compressed air to form a granule/air stream, which is subsequently passed through the powder delivery line, the spray gun, and the return hose to a granule separation device.

The granule/air stream may be formed using a compressed-air driven injector assembly having an inlet end connected to the outlet of the granule container, and an outlet end adapted for connection to an inlet end of the powder supply hose.

In an exemplary embodiment, the outlet of the granule container is disposed at a lower end thereof, and the granule container further includes a gravity separating screen, or sieve plate, disposed in the interior of the granule container. The sieve plate is angled downwardly toward the granule container outlet.

The granule separation assembly at the end of the return hose may include a cyclone strainer basket, with a separating air arrangement operatively connected to direct the stream of compressed air into the cyclone strainer basket. A granule collecting container may be provided beneath the cyclone strainer basket to receive granules that have been separated from the powder/granule/air stream exiting into the separation device.

Other objects and advantages of the present invention will be apparent upon reference to the accompanying description when taken in conjunction with the following drawings.

BRIEF DESCRIPTION OF THE DRAWINGS

FIG. 1 illustrates a schematic view of an exemplary embodiment of the present invention.

DESCRIPTION OF THE PREFERRED EMBODIMENT

In the drawing, 10 references a supply container for the cleaning granules. The container 10 has an outlet disposed at a lower end thereof, generally shown at the lower right of the container in FIG. 1. A gravity separating screen or sieve plate 11 is situated in the container 10, and is angled downwardly toward the outlet of the container 10. The sieve plate 11 facilitates delivery of the granules to an injector 12 connected to the output of the container 10, and allows granules having too small a grain size to pass into the bottom of the container 10. The injector 12 is operatively connected at its intake end to a compressed air feed line 13, its discharge end is connected to a powder delivery hose 15, which heads to a powder spray gun 16. The hose 15 can be connected to the injector 12 with a quick-disconnect coupling.

For coating operation of the gun 16, the powder delivery hose 15 is connected to a powder delivery (not shown), for example to the injector assembly of a powder supply and preparation container. When the hose 15 is to be cleaned for changing colors, the operator disconnects the hose 15 from the injector of the powder container, and connects the hose 15 to the output of the injector 12. With the hose 15 connected to the injector 12, compressed air is supplied through the conduit 13 to the injector 12, causing the injector 12 to draw granules from the granule container 10 and entrain them in compressed air. The resultant granule/air mixture is conducted through the hose conduit 15 and the spray gun 16, which discharges the granule/air mixture in spraying direction. The nozzle portion of the spray gun 16 is preferably removed for this cleaning phase, particularly when this involves a nozzle part having impact members. In place of the nozzle, a simple return hose 17 is connected to the front part of the gun. The hose 17 leads to a cyclone-like strainer basket in the form of a wire basket 18 arranged at the free end the return hose 17. The outlet end of the basket 18 is connected to a separating air nozzle 20 provided with a second compressed air feed line 19 and a granule collecting container 21. During the cleaning phase, the granule/powder/air mixture emerging from the return hose 17 proceeds into the wire basket 18, and powder is separated from the granules by the separating air emerging from the nozzle 20. The granules drop downwardly into the collecting container 21, and the powder, entrained by compressed air, proceeds to a powder filter (not shown) or to a standard compartment cleaning filter where the powder is separated from the air and supplied for re-use.

After the end of the cleaning phase, the compressed air feed lines 13 and 19 are disconnected, and the powder hose 15 is removed from the injector 12 and connected to the delivery for the new powder of the next coating process.

In practicing the present invention, it has been found to be particularly advantageous to use a plastic granulate that generates optimally little frictional charging, for example polyamide granulate with a grain size of between 1 and 3 mm, preferably 1.5 mm. The quantity of air used for conveying the granules preferably lies approximately one power of ten above that quantity of air that is usually employed for powder coating. This may be implemented simply by connecting the injector 12 directly to a compressed air source that usually has a pressure of 7 bar, and using a pressure reducer during coating operation. Additionally, the injector nozzle 12 may be provided which is relatively large by comparison to injectors used in powder coating. The granule density in the granule/air stream passing through the hose to be cleaned can selectively regulated such that there are predetermined distances between the individual granules. Thus, the granules do not move in "laminar" fashion within the hose but execute irregular ("dancing and helical") forward motions, so that they are hurled from one side of the hose wall to another, thus eroding powder residues from the inside walls of the hose.

Tests have shown that the granule cleaning process may be completed in approximately three minutes, with the hose exhibiting an extremely high degree of freedom from residue powder.

The injector 12 attached to the container 10 for the granulate as well as the wire basket 18 for the return of the granulate can be fashioned so that they can be simultaneously connected to a plurality of hoses, thus permitting several systems to be simultaneously cleaned.

Of course, numerous modifications are possible without departing from the scope of the invention. For example, the electrostatically neutral plastic granulate can also be replaced by a granulate that assumes a charge opposite that of the powder during the cleaning-charging, so that the two charges are then approximately compensated. The strainer basket 18 for separating the granulate, and the separating arrangement itself, could assume a variety of configurations.

Although the present invention has been described with reference to a specific embodiment, those of skill in the art will recognize that changes may be made thereto without departing from the scope and spirit of the invention as set forth in the appended claims.

We claim as our invention:

1. In an electrostatic powder coating system wherein air-entrained coating powder having a predetermined particle size is conducted through powder-carrying lines at a predetermined velocity and at a predetermined volume per unit time, a method of internally cleaning said powder-carrying lines to remove residual coating powder after coating operation of said system, said method comprising the following steps:

providing a supply of cleaning granules having a granule size greater than said particle size of said coating powder;

entraining said granules in a stream of compressed air to form a granule/air stream;

passing said granule/air stream through said powder-carrying lines, at a velocity in excess of said predetermined velocity of said air-entrained coating powder, to form a powder/granule/air stream; and separating said granules from said powder/-granule/air stream.

2. A method according to claim 1, wherein said step of passing said granule/air stream through said powder-carrying lines further comprises passing said granule-/air stream through said powder-carrying lines at a volume per unit time greater than said predetermined volume per unit time.

3. A method according to claim 1, wherein said step of providing a supply of cleaning granules further comprises providing a supply of cleaning granules having granule size of between 1 mm and 3 mm.

4. A method according to claim 3, wherein said step of providing a supply of cleaning granules further comprises providing a supply of cleaning granules having granule size approximately 1.5 mm.

5. A method according to claim 1, wherein said step of providing a supply of cleaning granules further comprises providing a supply of plastic granules.

6. A method according to claim 5, wherein said step of providing a supply of cleaning granules further comprises providing a supply of polyamide granules.

7. A method of internally cleaning powder-carrying lines to remove residual coating powder after coating operation of an electrostatic powder coating system including a spray gun having an outlet connected to a nozzle assembly, said spray gun being connected to a powder container via a powder delivery hose, said method comprising the following steps:

providing a supply of cleaning granules;

connecting said powder delivery hose to said supply of cleaning granules;

providing a return hose terminating in a granule separation device;

disconnecting said nozzle assembly from said spray gun outlet;

connecting said return hose to said spray gun outlet;

entraining said granules in a stream of compressed air to form a granule/air stream; and passing said granule/air stream through said powder delivery line, said spray gun, said return hose, and said granule separation device.

8. A method according to claim 7, wherein said step of providing a supply of cleaning granules comprises providing a granule container having an outlet connected to a compressed-air driven injector assembly having a hose connected at an outlet thereof.

9. A method according to claim 7, wherein said step of providing a supply of cleaning granules comprises providing a granule container having a lower end, with an outlet disposed at said lower end of said granule container, said outlet being connected to a compressed-air driven injector assembly having a hose connector at an outlet thereof, and a sieve plate, disposed in the interior of said granule container, angled downwardly toward said container outlet.

10. A method according to claim 7, wherein said step of providing a return hose terminating in a granule separation device comprises providing a granule separation device including a cyclone strainer basket operatively connected to a separating outlet and a granule collecting container.

* * * * *